US007547222B2

(12) United States Patent
Otten

(10) Patent No.: US 7,547,222 B2
(45) Date of Patent: Jun. 16, 2009

(54) ELECTRICAL CONNECTION ELEMENT FOR CONNECTING SUPPLY LINES, IN PARTICULAR IN AN AIRCRAFT

(75) Inventor: Jürgen Otten, Tiste (DE)

(73) Assignee: Airbus Deutschland GmbH (DE)

( * ) Notice: Subject to any disclaimer, the term of this patent is extended or adjusted under 35 U.S.C. 154(b) by 0 days.

(21) Appl. No.: 11/667,431

(22) PCT Filed: Nov. 24, 2005

(86) PCT No.: PCT/EP2005/012581

§ 371 (c)(1),
(2), (4) Date: May 8, 2007

(87) PCT Pub. No.: WO2006/056446

PCT Pub. Date: Jun. 1, 2006

(65) Prior Publication Data

US 2008/0102678 A1 May 1, 2008

(30) Foreign Application Priority Data

Nov. 24, 2004 (DE) ..... 10 2004 056 648

(51) Int. Cl.
*H01R 13/28* (2006.01)

(52) U.S. Cl. ..... 439/291

(58) Field of Classification Search ..... 439/291, 439/281, 462, 578, 675
See application file for complete search history.

(56) References Cited

U.S. PATENT DOCUMENTS

| | | | | |
|---|---|---|---|---|
| 4,834,678 | A * | 5/1989 | Emadi et al. | 439/701 |
| 5,842,894 | A | 12/1998 | Mehlberg | |
| 6,077,132 | A | 6/2000 | Gligorijevic | |
| 6,152,608 | A * | 11/2000 | Ghara et al. | 385/60 |
| 6,641,421 | B1 * | 11/2003 | Leavitt et al. | 439/271 |
| 7,097,486 | B2 * | 8/2006 | Parsons | 439/291 |

FOREIGN PATENT DOCUMENTS

| | | |
|---|---|---|
| DE | 1 839 468 | 10/1961 |
| DE | 80 19 782 U1 | 12/1980 |
| DE | 41 02 318 A1 | 8/1992 |
| DE | 94 12 215.6 U1 | 11/1994 |
| FR | 696.321 A | 12/1930 |
| FR | 2 307 169 A | 11/1976 |

* cited by examiner

*Primary Examiner*—Jean F Duverne
(74) *Attorney, Agent, or Firm*—Lerner, David, Littenberg, Krumholz & Mentlik, LLP

(57) ABSTRACT

An electrical connection element for connecting supply lines, in particular in an aircraft. The connection element comprises a connector socket and a connector that can be inserted into the connector socket, wherein the connector is axially rotatable in the connector socket, as a result of which a non-positive connection between the connector and the connector socket is established. An independent solution provides for the connection element to be made in a single piece and to comprise two clamping receptacles for the ends of the supply lines to be connected.

8 Claims, 3 Drawing Sheets

Fig. 1
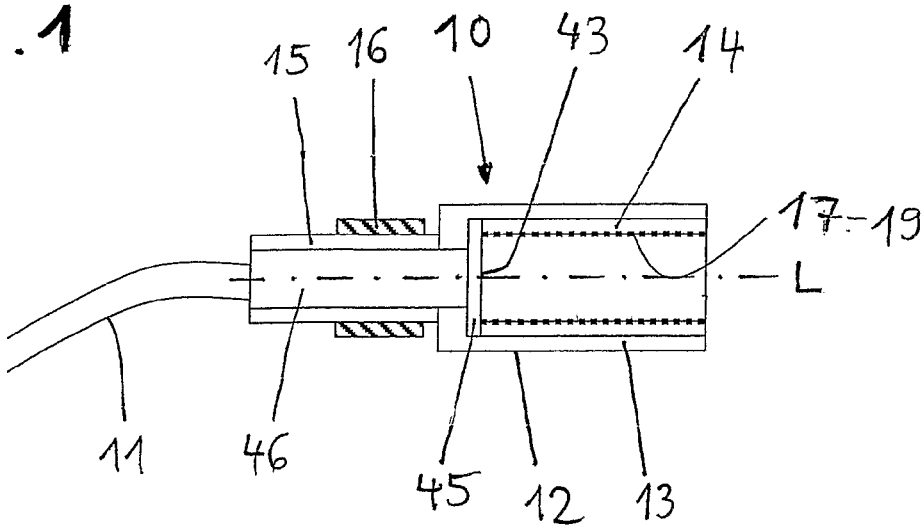
Fig. 2
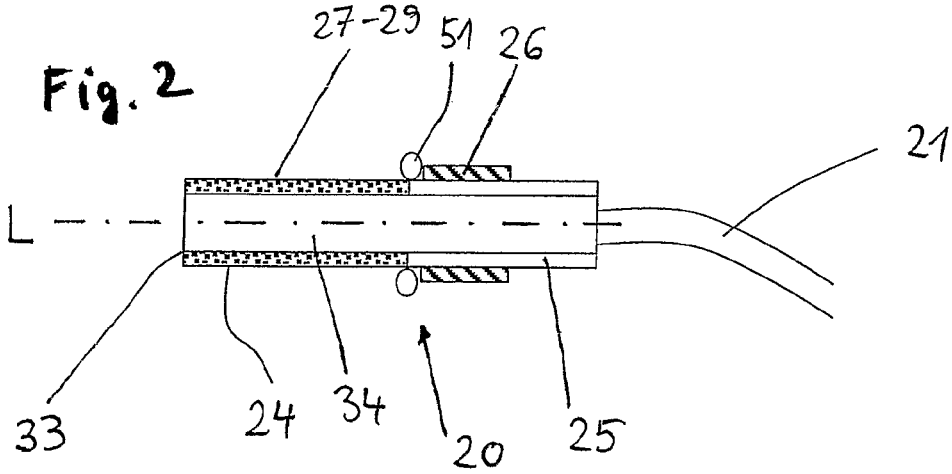
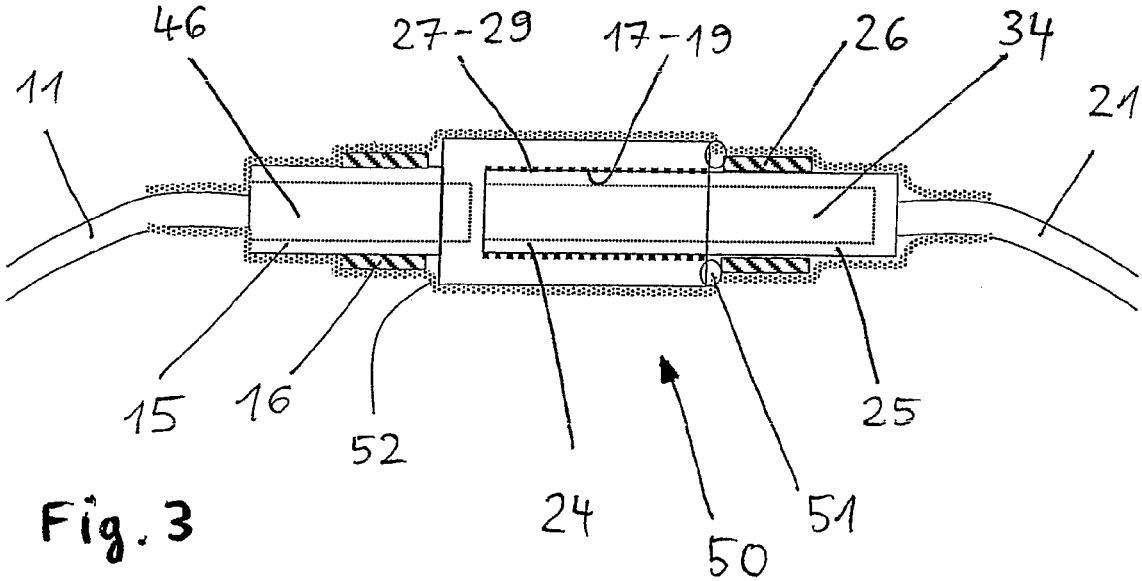
Fig. 3

Fig. 4
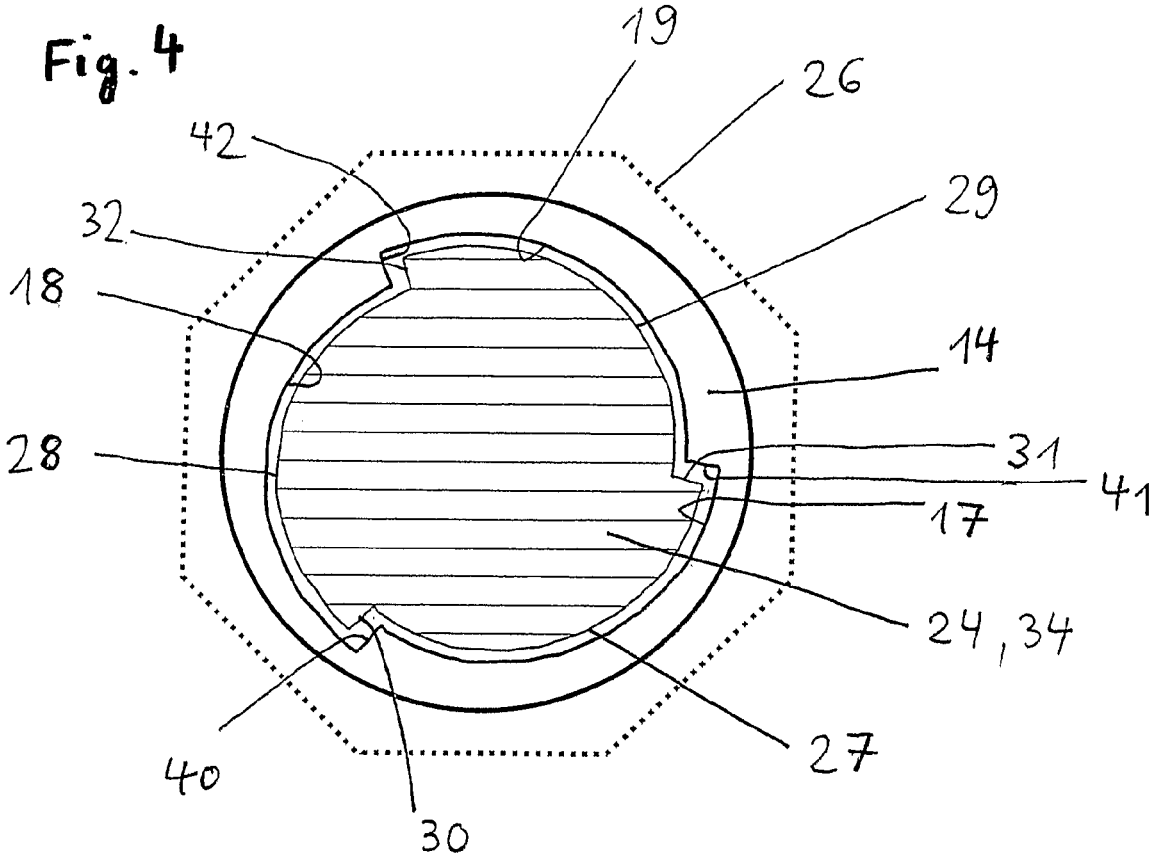
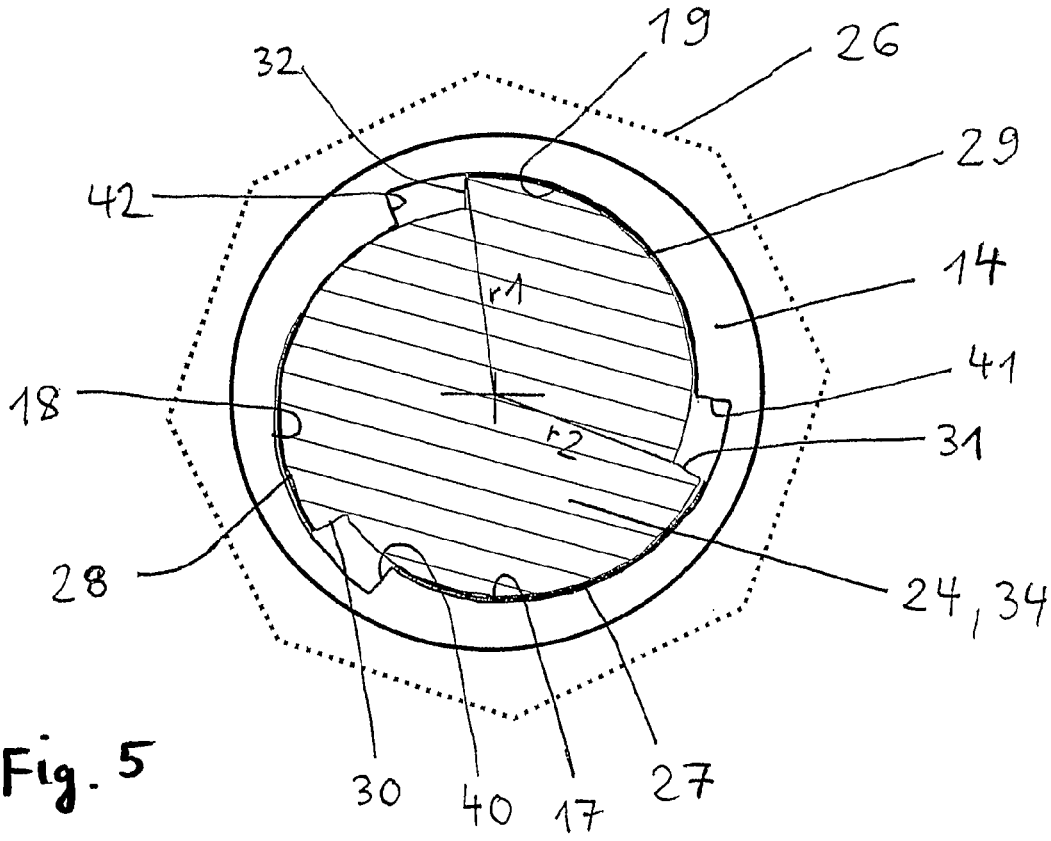
Fig. 5

ELECTRICAL CONNECTION ELEMENT FOR CONNECTING SUPPLY LINES, IN PARTICULAR IN AN AIRCRAFT

This application claims the benefit of the filing date of German Patent Application No. 10 2004 056 648.8 filed Nov. 24, 2004, the disclosure of which is hereby incorporated herein by reference.

FIELD OF THE INVENTION

The invention relates to an electrical connection element for connecting supply lines, in particular in an aircraft.

TECHNOLOGICAL BACKGROUND

To connect and branch off electrical supply lines in an aircraft the use of distributors comprising a base plate and threaded pins arranged thereon is known (DE 41 02 318 C2). Each end of the lines to be connected is connected to a conductive eyelet. The eyelets are placed over the threaded pin and are attached using a nut, as a result of which electrical contact is established. To avoid short circuits, a cover is provided. The described arrangement is expensive; with connecting and disconnecting the connector and the connector socket being complicated and time-consuming.

Such a threaded connection element is known from DE 94 12 215 U.

SUMMARY OF THE INVENTION

There may be a need to provide a simple electrical connection element which makes possible quick and secure connecting and disconnecting of the connection element.

This need may be met by a electrical connection element comprising the features of the independent claims.

According to an exemplary embodiment a connection element for connecting supply lines comprises a connector socket and a connector that is insertable into the connector socket, wherein the connector is axially rotatable in the connector socket, as a result of which a non-positive connection between the connector and the connector socket is established.

By using the rotary movement, a secure non-positive connection may be established in a simple manner. To establish the connection, the connector may be simply inserted into the connector socket and axially rotated, which may reduce the installation effort. The same may apply analogously for the disconnecting of the connection. Doing without a threaded pin may make it possible to reduce the expenditure and if need be to save weight. If need be it may be possible to do without a carrier for several connection elements.

Supply lines are lines to supply, in particular, aircraft components with electrical energy. The connection element according to the invention is therefore delimited in relation to electrical connectors for signal lines or control lines.

Connecting supply lines also includes the branching off of supply lines. Generally the invention includes the connection of any desired number of supply lines with any number of additional supply lines.

It may be particularly simple and therefore may be preferred if the electrical contact is generated by using non-positive connection between the connector and the connector socket. Therefore, the contact surfaces between the connector and the connector socket may be preferably electrically conductive, in particular metallic.

In another exemplary embodiment the connector and the connector socket comprise corresponding radially tapered contact surfaces. This may make it possible to provide the largest possible contact surfaces, and thus may secure contact, merely by axial rotation of the connector in the connector socket. Preferably, the number of the radially tapered contact surfaces of the connector and the connector socket respectively may be at least three so as to ensure an even mechanical load on the connector and the connector socket respectively. On the other hand, a large contact surface may be achieved by a small number of contact surfaces. The number of radially tapered contact surfaces of the connector and the connector socket respectively may be thus preferably at most five.

In an independent way of meeting the above need a connection element for connecting supply lines in aircraft may comprise, in particular, the connection element is essentially formed in one part and comprises two clamping receptacles for the ends of the supply lines to be connected.

The term "essentially" means "apart from parts that are insignificant in the context of the invention" and thus relates to the clamping receptacles and if necessary to a conductive adapter. For establishing the electrical and mechanical connection the supply lines may be simply inserted into the clamping receptacles and may be clamped into place. Doing without a threaded pin may make it possible to reduce the effort and to save weight. If need be, it may be possible to do without a carrier for several connection elements.

Further advantageous characteristics of the invention are provided in the dependent claims and in the following description of advantageous embodiments of the invention, with reference to the enclosed drawings.

BRIEF DESCRIPTION OF THE DRAWINGS

The following are shown:

FIG. 1 a longitudinal cross section of a connector socket;

FIG. 2 a longitudinal cross section of a connector;

FIG. 3 a longitudinal cross section of a connection element;

FIG. 4 a cross section of a connection element perpendicular to the longitudinal axis in the case of the connector being in place in the connector socket;

FIG. 5 a cross section of a firmly connected connection element perpendicular to the longitudinal axis;

DETAILED DESCRIPTION OF EXEMPLARY EMBODIMENTS

Figure 6:
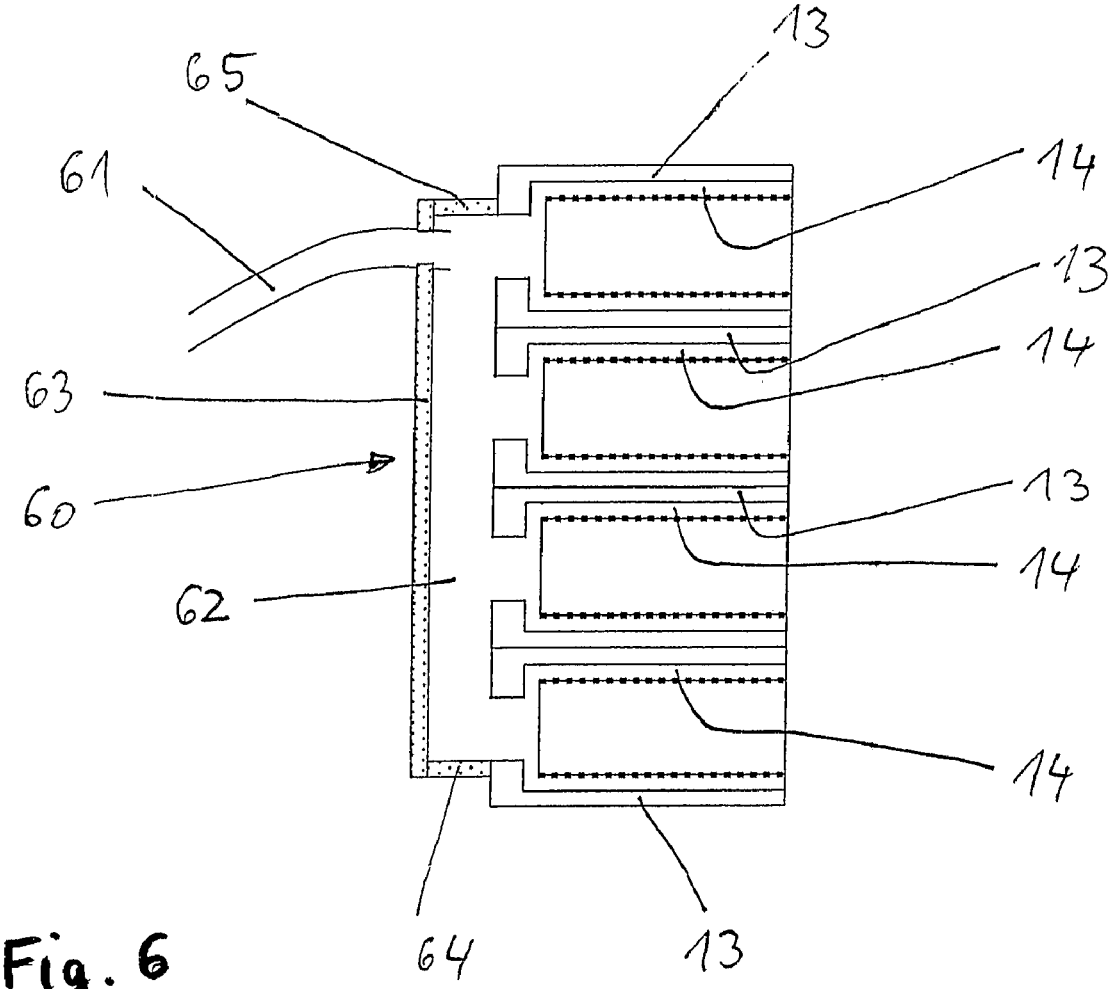
FIG. 6 a longitudinal cross section of a unit comprising several connector sockets.

In the figures identical or similar elements are labelled with identical or similar reference signs.

An electrical connection element 50 comprises a connector socket 10 and a connector 20. The connector socket 10 is connected to an electrical supply line 11 and comprises a cylindrical metallic receptacle 14 that is connected to the supply line 11 by way of a metallic bottom part 45 and a metallic adapter 46. The connector socket 10 comprises a housing 12 with a housing part 13 for the receptacle 14, and with a housing part 15 for the adaptor 46. An operating element 16 is attached to the housing part 15.

The connector 20 comprises a metallic contact pin 24, which by way of a metallic adaptor 34 is conductively connected to the supply line 21, as well as a housing part 25 with an operating element 26. In a cross section perpendicular to the longitudinal axis L of the connector 20, the contact pin 24 comprises outer metallic contact surfaces 27-29. The contact surfaces 27-29 of the contact pin 24 taper radially clockwise, as shown in FIGS. 4, 5: starting from the largest radial extension r1 the radius of the contact surface 29 (see FIG. 5) continuously diminishes clockwise until the minimum radial extension r2 is reached. The same applies to the contact surfaces 27, 28 of the contact pin 24. In each case the transition from the minimum to the maximum radial extension of the contact surfaces 27, 28, 29 is formed by an essentially radially aligned limit stop 30, 31, 32.

The receptacle 14 of the connector socket 10 comprises inner metallic contact surfaces 17-19 that correspond to the outer contact surfaces 27-29 of the connector 20 and therefore also taper off radially in clockwise direction. In each case the transition from the minimum to the maximum radial extension of the contact surfaces 17, 18, 19 is formed by an essentially radially extending limit stop 40, 41, 42.

For establishing the mechanical and electrical connection the contact pin 24 of the connector 20 is inserted into the receptacle 14 of the connector socket 10. In this arrangement the contact pin 24 is expediently oriented such that the limit stops 40-42 of the connector socket 10 form guides for the limit stops 30-32 of the contact pin 24. When the limit stops 40-42 of the connector socket 10 are in contact with the limit stops 30-32 of the connector 20, the external radius of the contact pin 24 is somewhat smaller than the internal radius of the receptacle 14 of the connector socket 10 so that in total a clearance of a few mm, for example ranging from 0.5 to 2 mm, results. This makes possible non-problematic insertion of the contact pin 24 into the receptacle 14 of the connector socket 10.

In the fully inserted position, for example, the face 33 of the contact pin 24 can rest against the bottom 43 of the receptacle 14 of the connector socket. In this position the connector socket 10 and the connector 20 are axially rotated clockwise against each other, i.e. on the longitudinal axis L of the connector 20 and the connector socket 10 respectively. This can for example take place by using tools applied to the operating elements 16, 26. Manual rotation is also possible. Rotation takes place until, due to their radial taper, the contact surfaces 27-29 of the contact pin 24 establish a non-positive and/or frictionally engaged connection with the contact surfaces 17-19 of the receptacle 14 of the connector socket 10. The closing angle, i.e. the angle between the limit stop and firm seating, as shown in FIG. 5, is for example 20° to 30°. By tightening the contact pin 24 in the receptacle 14 of the connector socket 10 at a suitable torque a mechanically and electrically secure connection between the contact pin 24 and the connector socket 10 can be achieved. Due to the identical shape of the contact surfaces 27-29 of the contact pin 24 and the contact surfaces 17-19 of the receptacle 14 of the connector socket 10, a large-area overlap between the contact surfaces (see FIG. 5) and thus safe contact even for high currents can be achieved. On the other hand, for given currents the design size of the connection element 50 can be kept small.

In order to improve operator comfort, a catch device can be provided so that the connector 20 in the closed position (see FIG. 5) clicks into the connector socket 10. To improve safety, in addition to the non-positive connection of the connector 20 and the connector socket 10, a locking device can be provided so as to lock the connector 20 in the closed position in the connector socket 10.

Preferably, the number of contact surfaces 17-19 and contact surfaces 27-29 respectively is at least three so as to ensure even loading of the connector 20 and of the connector socket 10 respectively. However, as shown in FIG. 5, four or more contact surfaces for each connector 20 and each connector socket 10 respectively at the same closing angle would reduce the contact surface overall. The number of radially tapering-off contact surfaces of the connector and of the connector socket respectively is thus preferably at most five, preferably precisely three. For reasons of stability, the contact surfaces 17-19 and 27-29 respectively are preferably arranged at even angular spacing, for example at 120° in the case of three contact surfaces (see FIGS. 4, 5).

The connector 20 and the connector socket 10 form a disconnectable connection element 50. To disconnect the connection element 50 the connector 20 is disconnected and rotated in the connector socket 10 in anticlockwise rotation, for example by using tools applied to the operating elements 16, 26, until the limit stops 30-32 come to rest against the limit stops 40-42 of the connector socket 10. In this position the contact pin 24 can be pulled with some play from the receptacle 14 of the connector socket 10, wherein the limit stops 40-42 of the connector socket form guides for the limit stops 30-32 of the contact pin 24.

Between the connector 20 and the connector socket 10 a seal or sealing means 51 for corrosion protection can be provided. Preferably, the housing 13, 15 of the connector socket 10 and the housing 25 of the connector 20 are insulating. Due to any complete insulation of the connection element 50 in the closed state no further measures to avoid short circuits and measures for corrosion protection are required. In addition, to provide corrosion protection or to provide an additional rotation safeguard, insulation 52 for the entire connection element 50 can be provided, for example in the form of a shrinkdown sleeve.

In the embodiment shown in FIG. 6 a socket unit 60 is provided having a plurality of connector receptacles 14 each adapted to receive one connector 20. All connector receptacles 14 are connected to a supply line 61 by way of a common electrically conductive carrier structure 62. Insulated positions 63-65 are provided for the carrier structure. In this way a distributor can be implemented i.e. connecting of a plurality of supply lines to a supply line wherein each of the plurality of supply lines is connected to a connector.

Figure 7:
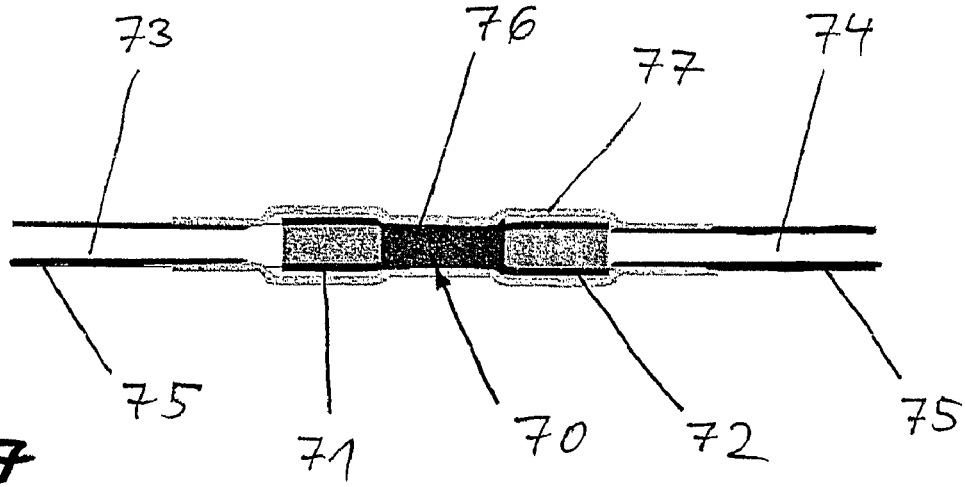
FIG. 7 a longitudinal cross-section of an essentially single-piece connection element.

In the alternative embodiment shown in FIG. 7 a single-piece connection element is provided, which comprises two clamping receptacles 71, 72 for the ends of two supply lines 73, 74 to be connected, which supply lines 73, 74 comprise insulation 75. The clamping receptacles 71, 72 are conductively connected in a single piece by means of a metallic adaptor 76. In order to establish a firm electrical and mechanical connection the free ends of the supply lines 73, 74 are inserted into the clamping receptacles 71, 72 and are clamped into place with a suitable tool. The connection element 70 is therefore preferably used for one-time connection of supply lines that need not be undone during the service life of the aircraft. Comprehensive insulation 77 for the connection element 70, for example in the form of a shrinkdown sleeve, can be provided.

It should be noted that the term "comprising" does not exclude other elements or steps and the "a" or "an" does not exclude a plurality. Also elements described in association with different embodiments may be combined. It should also be noted that reference signs in the claims shall not be construed as limiting the scope of the claims.

The invention claimed is:

1. An electrical connection element for connecting supply lines, wherein the connection element comprises:

a connector socket; and a connector wherein the connector and the connector socket comprise corresponding radially tapered contact surfaces, wherein each radially tapered contact surface tapers circumferential starting from a largest radial extension and continuously diminishing until a minimum radial extension is reached, wherein the connector is insertable into the connector socket, wherein the connector is axially rotatable in the connector socket, as a result of which a non-positive connection between the connector and the connector socket is established, and wherein the number of the radially tapered contact surfaces of the connector and the connector socket respectively is at least three.

2. The electrical connection element of claim 1, wherein electrical contact is generated by non-positive connection between the connector and the connector socket.

3. The electrical connection element of claim 1, wherein the connector is insertable into the connector socket with radial play.

4. The electrical connection element of claim 1, wherein the connector and the connector socket comprise corresponding radially extending limit stops.

5. The electrical connection element of claim 1, wherein the connector and the connector socket comprise elements for applying tools.

6. The electrical connection element of claim 1, wherein a seal is provided between the connector and the connector socket.

7. The electrical connection element of claim 1, wherein the connector and the connector socket comprise an insulating housing.

8. The electrical connection element of claim 1, further comprising a catch and/or lock device for catching and/or locking the connector in the connector socket in the closed position.

* * * * *